United States Patent [19]

Lemke

[11] Patent Number: 4,576,662

[45] Date of Patent: Mar. 18, 1986

[54] PROCESS FOR LOCATING AND CONNECTING INDIVIDUAL CONDUCTORS IN A MULTI-LAYER CONCENTRIC LAY CABLE

[75] Inventor: Timothy A. Lemke, Carlisle, Pa.

[73] Assignee: E. I. Du Pont de Nemours and Company, Wilmington, Del.

[21] Appl. No.: 668,423

[22] Filed: Nov. 5, 1984

[51] Int. Cl.[4] ..... H01B 13/00

[52] U.S. Cl. ..... 156/52; 29/749; 29/857; 156/55; 174/117 F

[58] Field of Search ..... 29/749, 857; 156/52, 156/55; 174/72 A, 113 R, 117 F

[56] References Cited

U.S. PATENT DOCUMENTS

| | | | |
|---|---|---|---|
| 3,627,903 | 12/1971 | Plummer | 174/72 A |
| 4,107,838 | 8/1978 | Keen et al. | 29/628 |
| 4,397,084 | 8/1983 | Ebrey et al. | 29/749 |

*Primary Examiner*—Robert A. Dawson

[57] ABSTRACT

The individual conductors in each layer of a layered cable are located and connected by first joining each of the conductors in the layer and thereafter separating the conjoined conductors along a predetermined path defined by reference to a predetermined indicia carried by one of the conductors in the layer.

20 Claims, 7 Drawing Figures

Fig. 1
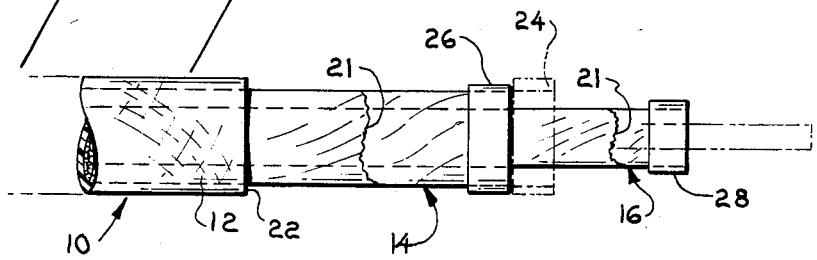
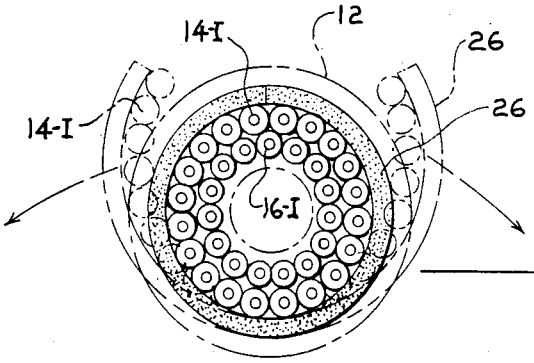
Fig. 2A
Fig. 3A
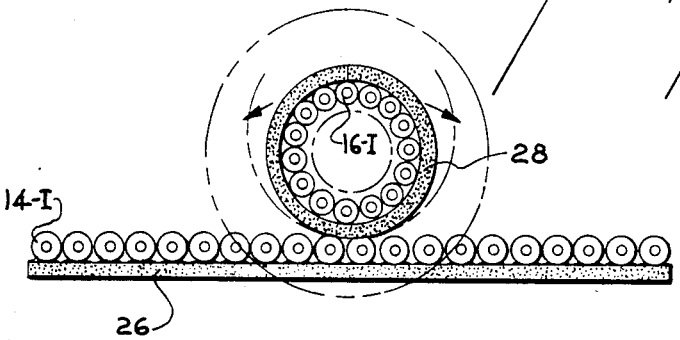
Fig. 4A
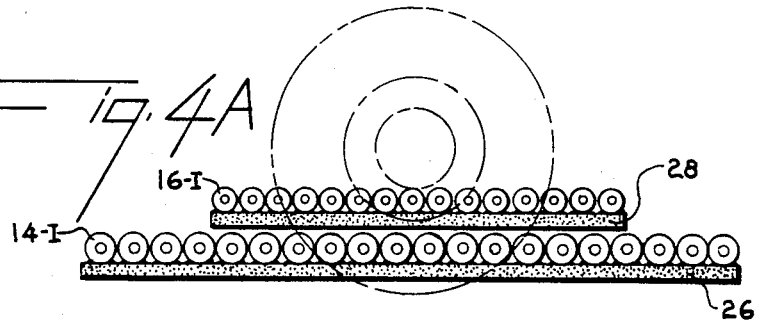

PROCESS FOR LOCATING AND CONNECTING INDIVIDUAL CONDUCTORS IN A MULTI-LAYER CONCENTRIC LAY CABLE

BACKGROUND OF THE INVENTION

This invention relates to a process for ordering each conductor in each layer of a multi-layer cable.

DESCRIPTION OF THE PRIOR ART

The single greatest labor and quality factor associated with the production of connected round cable and cable assemblies is the ordering of the individual conductors in the cable and the assembly of the conductors into the connector. Presently this task is accomplished by either color coding or by electrical inspection, commonly called "ring out".

In color-coded cables each individual conductor in the cable is identified by means of a particular color or color pattern provided on the insulation thereof. Each of these color-coded conductors must be individually identified and placed in a predetermined array. Typically, when connecting such a cable to a connector, the individual conductors may have terminals attached to them in a random manner. Thereafter the conductors are duly identified using their color codes and placed into a predetermined position into a connector housing. This is done at both ends of the cable.

In the ring-out system all conductors are typically the same color with no visual means of discriminating among them. The conductors at one end of the cable are terminated at random and are inserted into the connector housing in a random fashion. This may be accomplished relatively quickly. However, at the other end of the cable each of the conductors must be individually identified by completing an electrical circuit. The first end of the cable is inserted into a test unit and an electric current is sequentially applied to the individual pin of the unit associated with each conductor. Each conductor on the other end of the cable is sequentially tested by an operator to determine whether that conductor forms part of the circuit at a given time. Once a particular conductor is located it is inserted into position in a connector or other fixture or receptacle. This process is repeated with each conductor in the cable until all the conductors are identified and positioned.

Attempts have been made in the art to automate the location and connection of each end of the individual conductors of a multi-layer cable. Exemplary of such attempts are devices disclosed by U.S. Pat. No. 4,107,838 (Keen et al.) and U.S. Pat. No. 4,397,084 (Ebrey et al.). In these instances the cables are automatically probed by slicing through the insulation. When the proper conductor is located it is selected and placed in its proper position. However, this solution to the ordering problem can present other problems. Automatic routing of the conductors can result in the individual conductors looping over each other in a random matter, thus creating tangling and knotting and producing a generally untidy appearance. This is not a serious problem in designs in which there is sufficient space in the connector to accommodate the wire bundling. However, in cases where the individual conductors are large the knotting problem could be a serious disadvantage.

In view of the foregoing, therefore, it is believed advantageous to provide a process by which each end of individual conductors in each layer of a concentric multi-layered cable are quickly and efficiently located and connected into an appropriate receptacle.

SUMMARY OF THE INVENTION

Recognizing that the construction of a concentric lay cable is an orderly structure in the sense that each conductor in each layer occupies a definite spatial relationship with respect to each other conductor in that layer, the process in accordance with the present invention is believed to provide an efficient and expeditious method of ordering each conductor in the layer; that is, locating each conductor and connecting it at each end of the cable in a corresponding electrical relationship.

In accordance with the present invention, once the insulating jacket is removed from the cable, each of the individual conductors in each layer of the multi-layer cable is joined to the other conductors in that layer. One of the conductors in each layer is provided with a predetermined indicia. After conjointure, the layer is separated along a predetermined path defined with reference to the predetermined indicia disposed on a conductor within the layer. The now-separated layer may be opened into a generally planar configuration in which the axis of each of the conductors in the layer is generally parallel and coplanar, at least in the vicinity in its end, with the axis of the other conductors in the layer and are thus in a condition where they are insertable into a suitable receptacle, such as a connector or other fixture or apparatus.

The process is repeated for each layer in the concentric layer cable. In a multi-layer cable, the invention in its preferred form includes the step of step-wise stripping the cable such that the inner of any two radially adjacent layers extends axially further from a predetermined reference point than does the outer of the radially adjacent layers.

The conjointure of the conductors may be effected in any suitable manner. For example, the conductors may be mechanically connected by heat sealing using a portion of the metalized film sheath that surrounds each layer. Alternatively, the conductors may be joined by an adhesive band such that a portion of the exterior of each conductor is in contact with the band.

BRIEF DESCRIPTION OF THE DRAWINGS

The invention will be more fully understood from the following detailed description thereof taken in connection with the accompanying drawings which form a part of this application and in which:

FIG. 1 is a side elevational view of one end of a multi-layer concentric lay cable in a step-wise stripped condition; and, FIGS. 2, 3 and 4 are, respectively, perspective views of the cable of FIG. 1 at various predetermined points during the practice of the process of the present invention while

DETAILED DESCRIPTION OF THE INVENTION

Figure 2:
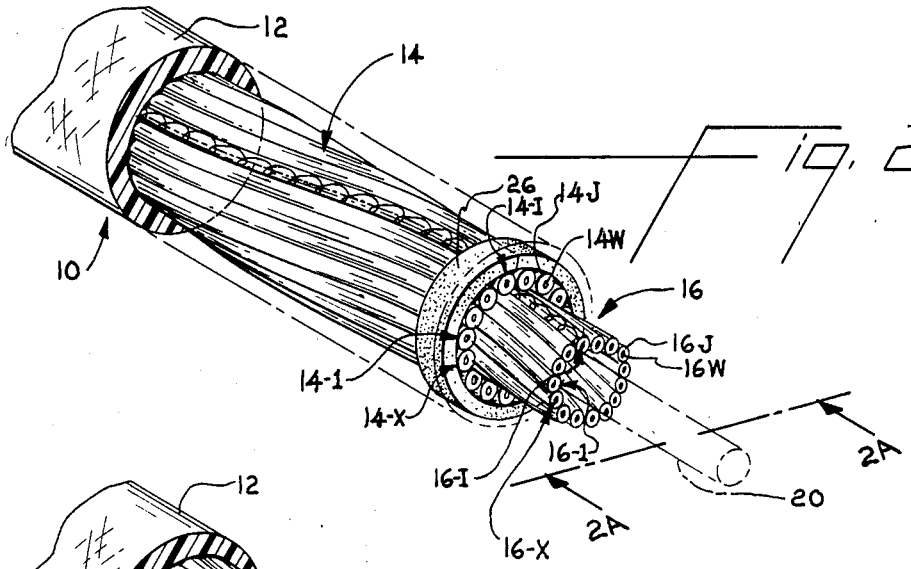
FIGS. 2A, 3A and 4A depict elevational views taken along the view lines indicated in FIGS. 2, 3 and 4 respectively.

Throughout the following detailed description similar reference numerals refer to similar elements in all figures of the drawings.

In accordance with the present invention a process is provided for ordering the individual conductors provided in each layer of conductors in a single layer or in a concentric multi-layer round cable generally indicated by reference character 10. As used herein the term "ordering" refers to the location and connection of the individual conductors in a layer in an organized and efficiently managed manner. One end of the cable 10 is shown in the figures. Similar steps to those hereafter discussed are, of course, practiced at the opposite cable end.

The cable 10 includes an outer jacket 12 formed from a suitable insulating material such as polyvinyl chloride. The cable 10 includes a plurality N (in instance of the figures N being two) concentrically disposed layers 14, 16 of individual conductors arranged within the jacket 12. Each conductor itself includes an insulating jacket 14J, 16J (FIG. 2) surrounding a conducting wire 14W, 16W. Any predetermined number of conductor layers (including a single layer) may be present in the cable and the conductors in each such layer may be ordered in accordance of the teachings of the present invention. Each layer 14, 16 includes a predetermined plurality X of individual conductors indicated by the characters 14-1 through 14-X for the layer 14 and 16-1 through 16-X for the layer 16. Of course, the layers 14, 16 need not be truly concentrically disposed for use in the process of the present invention but may take any cross-sectional shape so long as the construction imparts an orderly structure thereto. The inner layer 16 surrounds an axially extending optional core 20. A metalized film sheath 21 (shown only in FIG. 1) surrounds each of the layers 14, 16.

In preparation for the practice of this invention the insulation jacket 12 is removed from the cable 10 and the layers 14, 16 may be stepped as shown in the figures whereby the inner of any two radially adjacent layers of conductors in each array extend axially further from a predetermined reference point 22 (as the end of the insulation jacket 12) than does the radially outer layer. A portion of the jacket 12 may optionally be left to form a collar 24 (FIG. 1) to assist in maintaining the cable 10 in a more easily workable form, if desired. However, it should be understood that such preliminary stepping of the conductor layers 14, 16 in the manner discussed is not required.

Each of the layers of conductors 14, 16 includes a conductor having a predetermined indicia thereon. Such conductors may be referred to as "index conductors" and are indicated by the reference character 14I, 16I for the layers 14, 16, respectively. Since the concentric lay cable is an orderly structure, given a predetermined reference datum such as an index conductor the angular position of each conductor in the layer is known with respect to the datum. In the drawings the index conductor is indicated by spiral striping although any suitable color coding or any other means whereby the index conductor 14I, 16I may be identified and distinguished from the remainder of the conductors in the layer may be used and lies within the contemplation of this invention.

In accordance with the process of the present invention each of the conductors in each of the layer is joined to the other conductors in that layer. Any suitable expedient for joining the conductors in a layer may be used. For example, the conductors may be mechanically joined by heating a portion of the sheath 21 (preferably adjacent the end of the layer) so as to fuse together the sheath and the conductors in the layer. Alternatively the conductors may be joined by a connecting member 26, 28 in the form of a circumferentially disposed band of adhesive. The bands 26, 28 serve to physically secure all of the conductors in a given layer such that the insulating jacket 14J, 16J of each conductor in the layers 14, 16 contacts the respective band 26, 28. The condition of the cable 10 after this step is depicted in FIGS. 2 and 2A.

Thereafter, each layer 14, 16 is separated along a predetermined path defined in accordance with and by reference to the index conductor 14I, 16I in each layer. Any suitable separating device such as a blade may be used.

Figure 3:
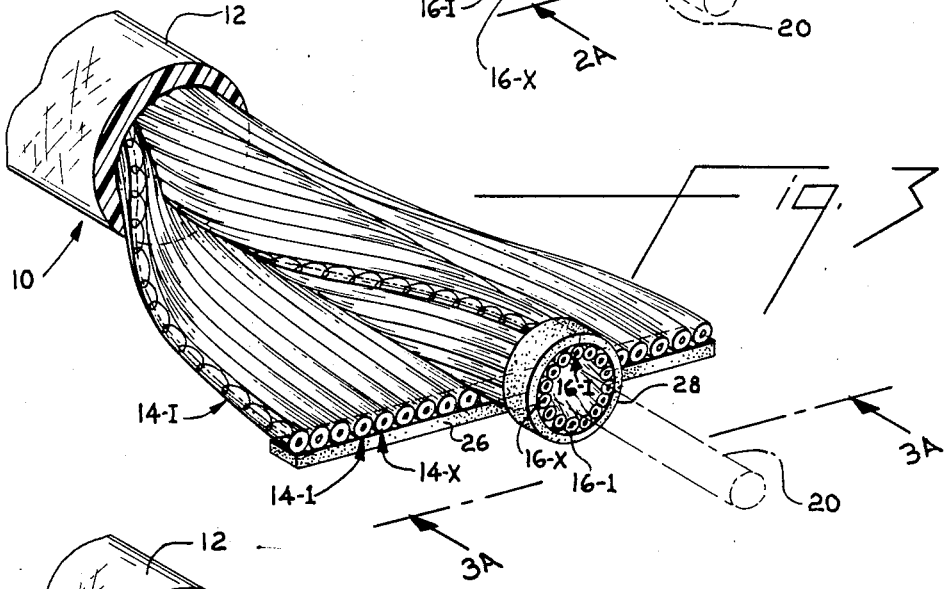

With the outer layer 14 separated along the path for a predetermined axial length the layer 14 may be developed, that is, reoriented from a configuration in which the axis of each of the conductors in that layer are parallel and lie on a generally circular locus into a relationship in which the axis of each of the conductors are parallel with each other and generally coplanar. Preferably, but not necessarily, the index conductor will then occupy a predetermined end position of the coplanar array. The condition of the cable at this point in the process is shown in FIGS. 3 and 3A.

Figure 4:
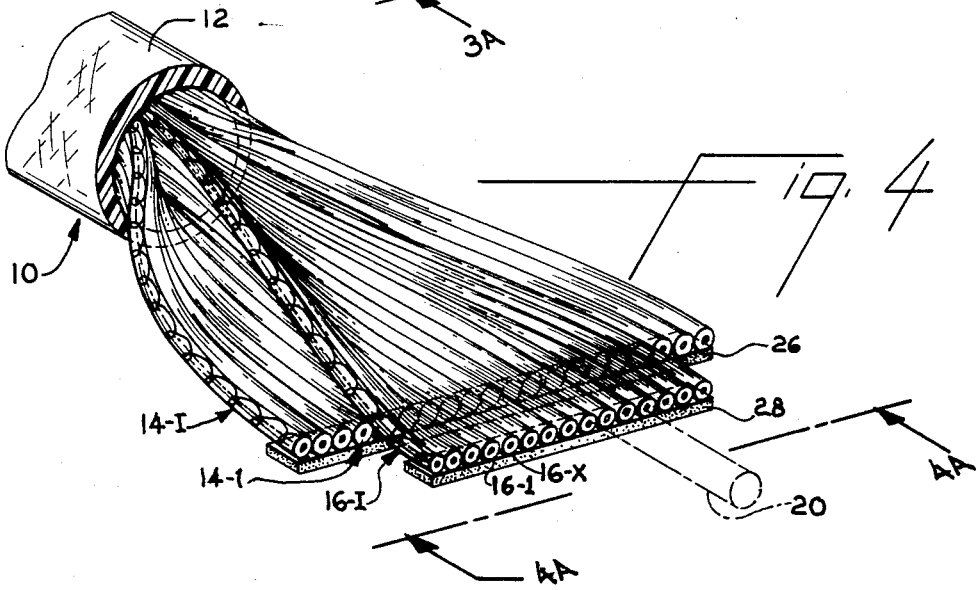

As seen from FIGS. 4 and 4A the next of the layers is operated upon in identically the same manner. That is, each of the conductors in the layer 16 are joined and thereafter separated along a path defined in accordance with the index conductor 16I. The conductors in this layer 16 are then developed in the manner discussed. The process is repeated for each of the N layers extant in a given cable.

Once each (or both or all) concentric layer(s) has been developed in the manner set forth the coplanar array of conductors may be easily inserted and introduced into a suitable receptacle, whether that receptacle be a connector or any other suitable fixture or apparatus for further operations.

In view of the foregoing it may be appreciated that the recognition of the orderliness of the structure of the typical concentric lay cable may be utilized to provide a basis whereby the individual conductors in each layer of the cable may be efficiently and expeditiously ordered. Those skilled in the art having the benefit of the teachings of the present invention as herein above set forth may effect numerous modifications to the sequentiality of the process steps above described. These modifications are, however, to be construed as lying within the scope of the present invention as defined by the appended claims.

What is claimed is:

1. A process for ordering the individual conductors in an individual layer of a round cable wherein each conductor in the layer abuts at least two other conductors in the layer, one of the conductors having a predetermined indicia thereon comprising the steps of:

(a) joining each of the conductors in the layer; and (b) separating the conjoined conductors along a predetermined path as defined by reference to the predetermined indicia.

2. The process of claim 1 further comprising the step of:

(c) opening the separated layer such that the axes of the conductors in the layer lie in a substantially coplanar relationship.

3. The process of claim 2 further comprising the step of:

(d) inserting the separated conductor layer in a receptacle.

4. The process of claim 1 further comprising the step of:

(d) inserting the separated conductor layer in a receptacle.

5. The process of claim 1 wherein the conductors are joined by banding the conductors with an adhesive band such that a portion of the exterior of each conductor is in contact with the band.

6. The process of claim 2 wherein the conductors are joined by banding the conductors with an adhesive band such that a portion of the exterior of each conductor is in contact with the band.

7. The process of claim 3 wherein the conductors are joined by banding the conductors with an adhesive band such that a portion of the exterior of each conductor is in contact with the band.

8. The process of claim 4 wherein the conductors are joined by banding the conductors with an adhesive band such that a portion of the exterior of each conductor is in contact with the band.

9. A process for ordering the individual conductors in each layer of a concentric lay multi-layered cable wherein one of the conductors in each layer has a predetermined indicia thereon comprising the steps of:

(a) joining each of the conductors in one of the concentric layers of conductors;

(b) separating the conjoined conductors along a predetermined path as defined by reference to the predetermined indicia in the layer; and (c) repeating steps (a) and (b) for each remaining layer of conductors in the cable.

10. The process of claim 9 wherein prior to step (a) the process further comprises the step of:

stepping the cable such that the inner of any two radially adjacent layers extends axially further from a reference point than does the outer of the radially adjacent layers.

11. The process of claim 9 further comprising the step of opening each separated layer such that the axes of the conductors in each layer lie in substantially coplanar relationship.

12. The process of claim 10 further comprising the step of opening each separated layer such that the axes of the conductors in each layer lie in substantially coplanar relationship.

13. The process of claim 9 wherein the conductors in each layer are joined by banding with an adhesive band such that a portion of the exterior of each conductors is in contact with the band.

14. The process of claim 10 wherein the conductors in each layer are joined by banding with an adhesive band such that a portion of the exterior of each conductors is in contact with the band.

15. The process of claim 11 wherein the conductors in each layer are joined by banding with an adhesive band such that a portion of the exterior of each conductors is in contact with the band.

16. The process of claim 12 wherein the conductors in each layer are joined by banding with an adhesive band such that a portion of the exterior of each conductors is in contact with the band.

17. The process of claim 9 further comprising the step of inserting each separated layer in a receptacle.

18. The process of claim 10 further comprising the step of inserting each separated layer in a receptacle.

19. The process of claim 11 further comprising the step of inserting each separated layer in a receptacle.

20. The process of claim 12 further comprising the step of inserting each separated layer in a receptacle.

* * * * *